United States Patent [19]

Mercurio

[11] Patent Number: 5,007,519

[45] Date of Patent: Apr. 16, 1991

[54] COIN DROP CONSTRUCTION

[75] Inventor: Leonard Mercurio, Dix Hills, N.Y.

[73] Assignee: Set-O-Matic Sales Corp., Cedarhurst, N.Y.

[21] Appl. No.: 468,006

[22] Filed: Jan. 22, 1990

[51] Int. Cl.[5] ..... G07F 5/16; G07D 5/04

[52] U.S. Cl. ..... 194/230; 194/338; 194/341; 194/351

[58] Field of Search ..... 194/339, 340, 341, 351, 194/229, 230

[56] References Cited

U.S. PATENT DOCUMENTS 1,897,909 2/1933 Leeson ..... 194/340

FOREIGN PATENT DOCUMENTS 3513767 10/1986 Fed. Rep. of Germany ..... 194/351

589888 7/1947 United Kingdom ..... 194/351

*Primary Examiner*—F. J. Bartuska

*Attorney, Agent, or Firm*—Charles E. Temko

[57] ABSTRACT

An improved coin drop construction suitable for replacing the coin slide elements of a coin collector box forming part of a coin operated appliance comprising a front mounting plate adapted to overlie an opening in the appliance, and a coin guide element carried by an inner surface of the mounting plate and serving to guide inserted coins to the collection box; the guide element including first and second plates interconnected in spaced parallel relation to define an elongated coin channel therebetween, the mounting plate having a coin receiving opening communicating with the channel; a first coin blocking member pivotally mounted between the plates at a first end thereof, the member including a first end located in the area of the coin receiving opening, and having an upper longiutudinal edge surface forming a path for conducting a coin therealong; an elongated track member in fixed relation between said plates and having an upper surface forming a continuation of the upper edge of the first coin blocking member when at a lower limit of its path of travel, a resilient member bearing upon the first coin blocking member to at least partially block said opening; insertion of a coin through the opening serving to momentarily displace the member downwardly to permit passage of the coin, release of the coin permitting the member to return to its initial position, in which the upper edge is positioned above the upper surface, and the coin is rolled over the edge under the action of gravity to a second end of the track member; a second coin blocking member positioned at said second end of the track member, the second coin blocking member including a pivotally mounted plate forming a continuation of the upper surface of the track member in the presence of an underweight coin, and being pivotally displaced under the weight of a properly weighted coin to allow the coin to fall into the coin collection box.

7 Claims, 4 Drawing Sheets

COIN DROP CONSTRUCTION

Reference is made to my copending application Ser. No. 07/297,480 filed Jan. 17, 1989, under the title Coin Drop Construction which discloses and claims a related invention, said application being assigned to the same assignee as the present application.

BACKGROUND OF THE INVENTION

This invention relates generally to the the field of coin drop mechanisms used with coin operated commercial appliances and equipment, and more particularly to an improved form thereof suitable for replacing existing coin slide elements in coin collector boxes.

Coin slides have been used for may years, and while effective, they are subject to wear, jamming and other functions during operation. They are also more vulnerable to tampering by unauthorized persons than would be desired. A more serious disadvantage lies in their lack of adaptability to provide for acceptance of larger number of coins necessitated by the increased cost of continued operation of the appliances with passage of time. However, many such devices are presently in operation, and it is desirable to be able to replace the coin slide elements alone in existing coin boxes, rather than discard the entire coin collection box.

In my above-mentioned copending application, there is disclosed a construction including a simple pivotal link mechanism having a minimum number of moving parts, which mechanism is of a minimum height so as to be readily installable in the vertical space and opening created by the removal of the existing coin slide elements forming a part of a collector box. The structure includes a mounting plate having a through opening for the insertion of coins, which, in installed condition, covers the above-mentioned opening. Supported by the plate is a receptor and guide element comprising a pair of parallel plates defining a passage therebetween. The plates mount a pivotally mounted lever, one end of which is opposite the coin slot in the mounting plate. The lever is resiliently biased to partially block the coin slot and is pivoted downwardly upon the insertion of a coin. This movement actuates means inhibiting the insertion of a second coin until the first coin has cleared for acceptance. Upon release of the coin, the lever pivots in an opposite direction, forming an inclined surface over which the coin rolls to an opposite end of the lever. The lever continues to pivot as the coin travels over the inclined surface, and as the coin reaches the second end, it falls into a coin chute in known manner. The coin is prevented from overshooting the drop opening by an adjustable stop mounted between the supporting plates. As the resilient forces required are small, they are provided by a small weight, rather than a spring.

While this construction is effective, it has been found that the openings in some appliances in which the coin drop mechanism is installed have been less than standard height owing to the nature and configuration of the coin slide mechanism which the construction replaces. As a result, there is not sufficient room to accommodate the parallel plates therebehind at the inclined angle necessary for proper operation of the pivotally mounted lever. Since it is desirable that the coin drop device be installed without physically modifying the dimension of the space in which it is disposed, there arises a need for a modified construction which will perform the same functions while occupying a space of lesser height within the coin operated device.

SUMMARY OF THE INVENTION

Briefly stated, the invention contemplates an improved coin drop construction of the class described in which the effective height thereof is substantially reduced to permit installation in a coin slide recess of relatively lower height. To this end, the pivotally mounted lever of my earlier construction is replaced by a fixed inclined coin supporting surface and a separate pivotally mounted coin blocking means having an upper surface which aligns with the fixed surface after passage of a coin through the coin slot in the mounting plate. At an opposite end of the fixed surface is a second pivotally mounted coin blocking member which normally closes a downwardly extending opening to the coin box, but which is displaced under the weight of a genuine coin. In the case of an underweight, but fully sized slug, the member is not displaced, and the slug is guided past the opening to the coin box for rejection. As is the case in the earlier construction, employing a pivotally mounted lever, the first coin blocking means is adapted to lift the deposited coin after release by the user, and imparts momentum thereto, a directional component of which starts the coin with an initial velocity over the fixed surface sufficient to deflect the second coin blocking member upon contact therewith. As the angle of the fixed surface is closer to the horizontal when compared with the earlier construction, the initially imparted momentum is correspondingly greater to assure proper operation.

BRIEF DESCRIPTION OF THE DRAWINGS

In the drawings, to which reference will be made in the specification, similar reference characters have been employed to designate corresponding parts through the several views.

FIG. I is a front elevational view of a first embodiment of a a coin drop device embodying the invention.

DETAILED DESCRIPTION OF THE DISCLOSED EMBODIMENT

Figure 2:
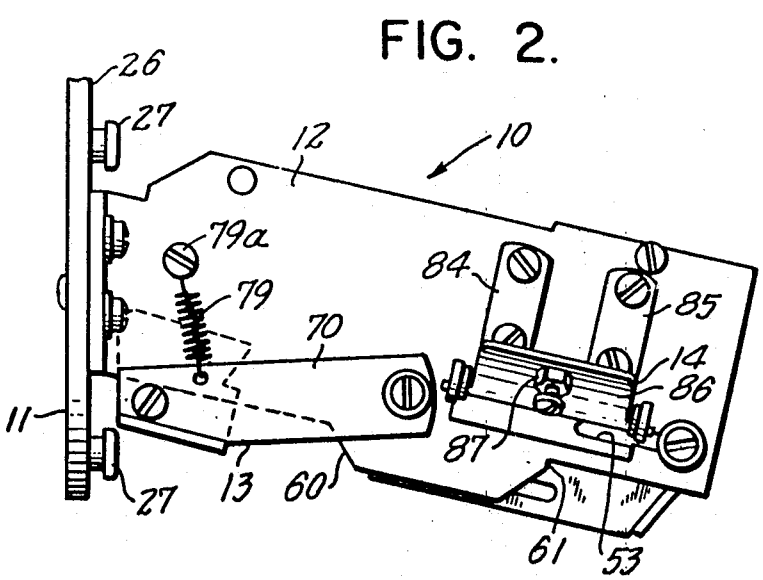
FIG. 2 is a side elevational view thereof.
Figure 1:
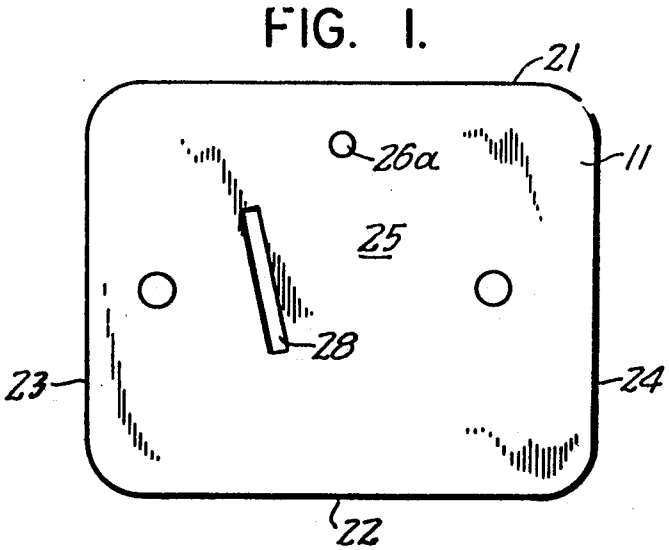
Figure 4:
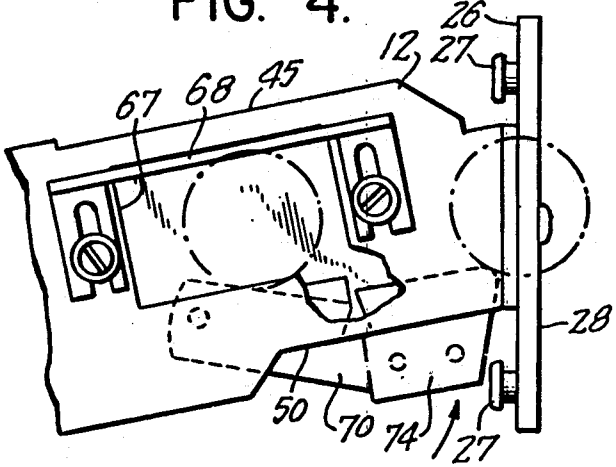
FIG. 4 is a similar side elevational view showing certain of the component parts in altered relative position.
Figure 3:
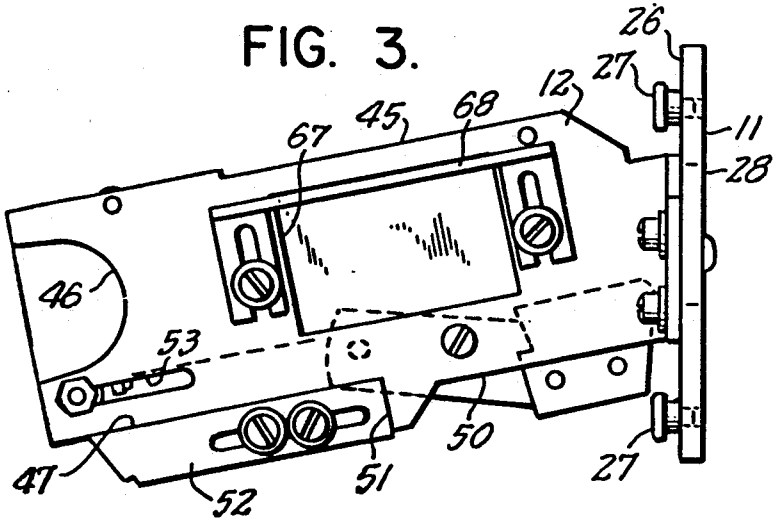
FIG. 3 is a side elevational view thereof showing the side opposite that seen in FIG. 2.
Figure 6:
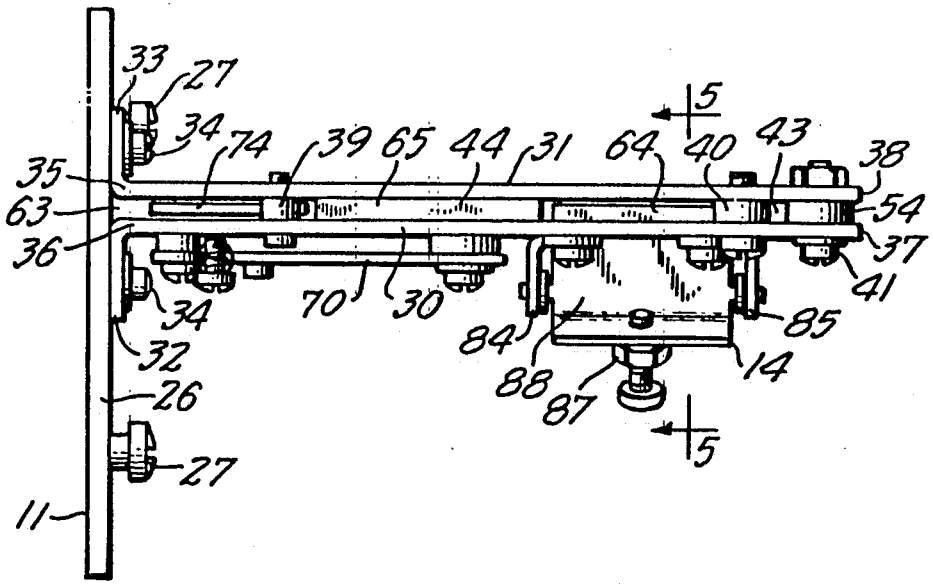
FIG. 6 is a top plan view thereof.
Figure 7:
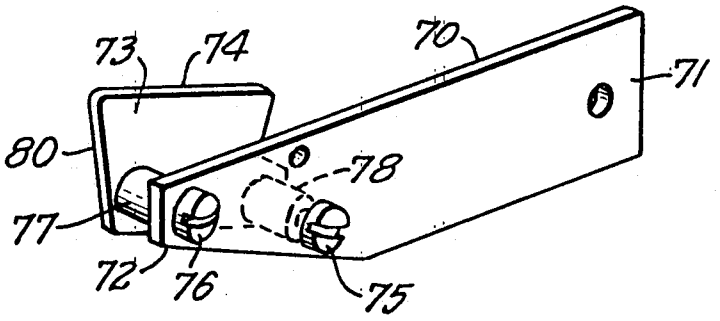
FIG. 7 is a front prospective view of a second embodiment of the invention.
Figure 5:
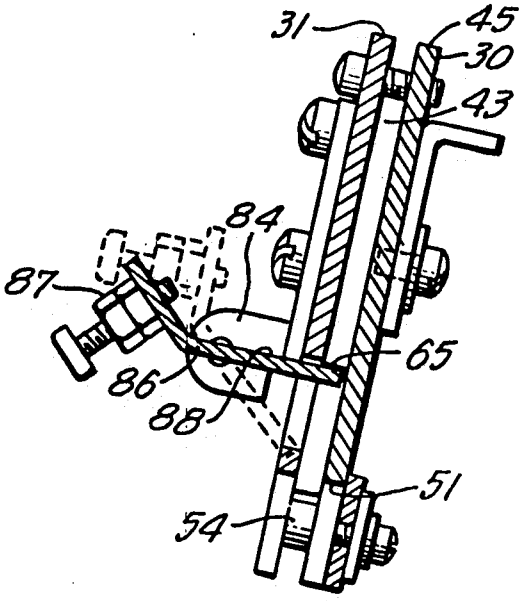
FIG. 5 is a cross-sectional view as seen from the plane 5—5 in FIG. 6.

In accordance with the first embodiment of the invention, the device, generally indicated by reference character 10, comprises broadly: a front mounting plate 11, a coin guide element 12 and coin control means including first and second coin blocking means 13 and 14, respectively.

The front mounting plate 11 is generally rectangular in configuration, and is bounded by an upper edge 21, a lower edge 22, side edges 23 and 24, a front surface 25, and a rear surface 26. The plate is aligned with the coin box (not shown) by screws 27 having heads which are concealed behind the rear surface 26, and will normally utilize mounting holes (not shown) aligned with hole **26*a* made available by the removal of the coin slide element. Extending between the surfaces 25–26 is an angularly disposed coin slot 28**.

The guide element 12 includes first and second parallel plates 30 and 31, each including a mounting flange 32–33 secured by screw means 34 at front ends 35–36. Each of the plates includes a second end 37–38. The plates are maintained in parallel spaced position by washers 39 and 40 engaged by threaded screws 41 and 42, respectively, thus providing an elongated coin channel 43. A fixed track member 44 is positioned within the channel.

The plate 30 is bounded by an upper edge 45, a rear-recess edge 46, and a lower edge 47. The lower edge 47 includes a first recess 50 for the means 13, and a second recess 51 to accommodate a bracket 52 supporting a coin operated switch (not shown) of known type. An elongated slot 53 adjustably positions a stop washer 54 which serves to halt movement of a coin in a generally horizontal direction in order that it may drop vertically into the coin collection box. The washer 54 may be of rubber or other energy-absorbing material.

The plate 31 is generally congruent, and includes a recess 60 corresponding to the recess 50, as well as a recess 61 corresponding to the recess 51.

The channel 43 is of elongated configuration, and extends from a first end 63 to a second end 64 to define a coin track surface 65. A rectangular opening 67 is provided in the plate 31 to permit rejection of undersized coins, this opening being provided with an adjustable upper edge member 68, as is known in the art.

The first coin blocking means 13 is located at the leading end of the member 43 and includes an exposed lever 70 having a first pivotally mounted end 71 and a second free end 72. The end 72 supports a laterally spaced terminal 73 having an upper surface 74 which is coaxially disposed with the track surface 65 when the lever is in its uppermost position. The terminal is positioned by screws 75 and 76 extending through washers 77 and 78. A contractile spring 79 interconnects the lever 70 with a screw **79*a* to urge the lever 70 to its uppermost position at which point it also partially blocks the slot 28 by positioning an edge 80** therebehind.

The second coin blocking means 14 is positioned at the opposite end of the member 43, and includes first and second support brackets 84 and 85 which support a pivotally mounted plate member 86 having adjustable weighting means 87 thereon, and an upper surface 88 which extends into the path of oncoming coins at the inner end of the track surface 65. The adjustable means 87 is positioned so that it will deflect under the weight of a properly weighted coin to permit the coin to drop downwardly from between the plates 30 and 31 into the coin collection box, horizontal movement being arrested by the stop washer 54. In the case of an underweighted coin, the plate member 86 will not deflect, and the coin continues in a generally horizontal direction past the washer 54 to a rejection means (not shown) for independent collection or return.

Turning now to the second embodiment of the invention shown in FIGS. 7–12, inclusive, parts corresponding to those of the first embodiment have been designated by similar reference characters with the additional prefix "1".

The second embodiment, while utilizing the basic concepts of the first embodiment, offers greater utility from the standpoint of coin acceptance capability, and improved facility in determining the acceptance and crediting of received coins. Provision has also incorporated for returning genuine coins of incorrect value.

While the first embodiment is structured to accept single and multiple insertions of a single coin, e.g. a twenty-five cent piece, the second embodiment is structured to accept coins of first and second denominations, e.g., twenty-five cent pieces and half-dollar or dollar coins. To accomplish this end, the channel structure forms two parallel channels that are fed by separate coin slots, each utilizing the same first and second coin blocking means 112 and 113 in selective fashion. The coin rejecting opening 167 overlies the opening 67, so that undersized coins of either denomination pass through the same path of rejection, substantially laterally with respect to the principal axes of the channels. A coin baffle plate 48 restricts the height of the channels 43 and 143 to prevent excess vertical movement of inserted coins, which might be exploited by a user to frustrate the operation of the coin acceptance function.

An optional coin return mechanism 90 is also provided which comprises a pivotally mounted chute 91 supported for pivotal movement upon a longitudinally oriented rod 92, a forward end of which projects through an opening in the plate 130 and mounts an operating lever 93. The lever 93 blocks a coin return slot 94 in the plate 130 until move to a return position, which also aligns the upper surface of the chute 91 with the slot 94 to return rejected coins of any denomination to the user.

Figure 9:
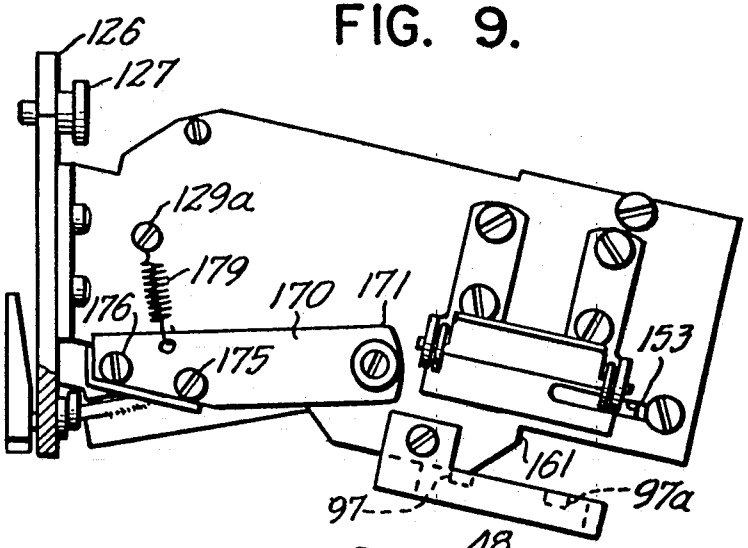
FIG. 9 is a side elevational view corresponding to that seen in FIG. 2.
Figure 11:
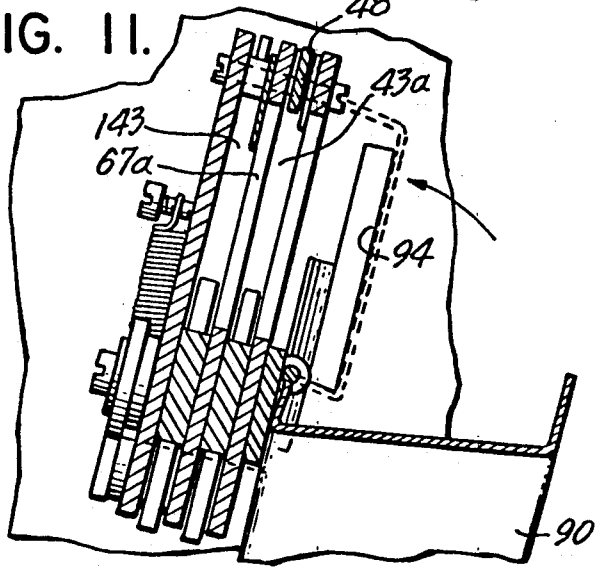
FIG. 11 is a cross sectional view of the second embodiment as seen from a point 11—11 in FIG. 10.
Figure 8:
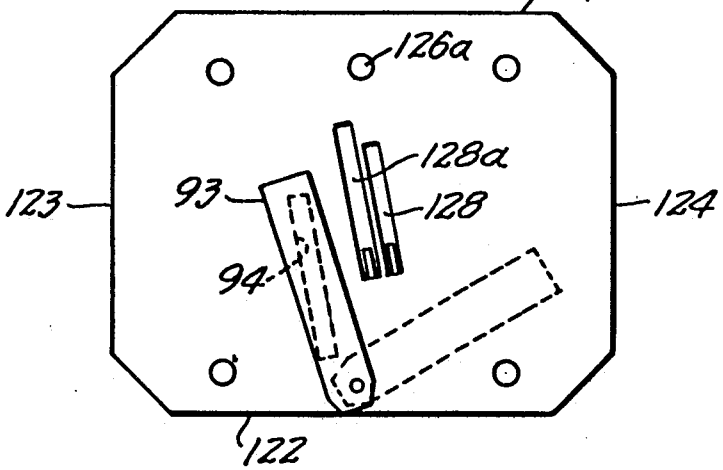
FIG. 8 is a front elevational view of the second embodiment corresponding to that seen in FIG. 1 of the first embodiment.
Figure 10:
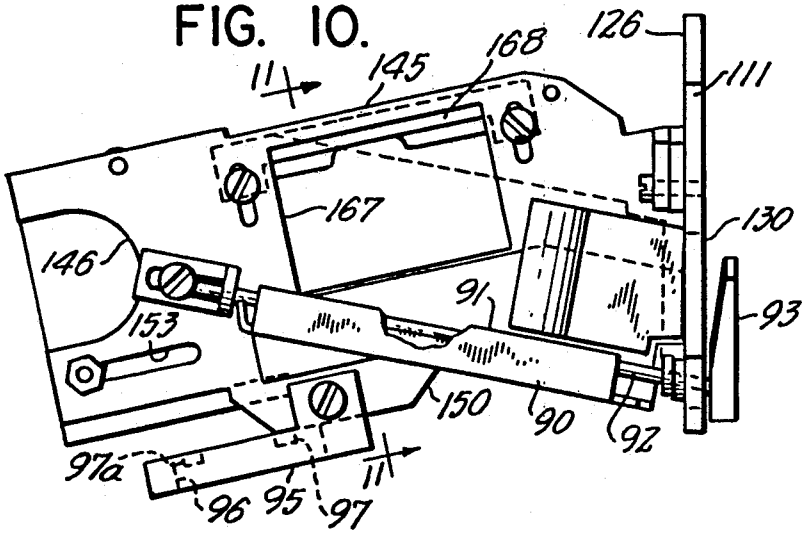
FIG. 10 is a side elevational view of the second embodiment showing the side opposite that seen in FIG. 9.
Figure 13:
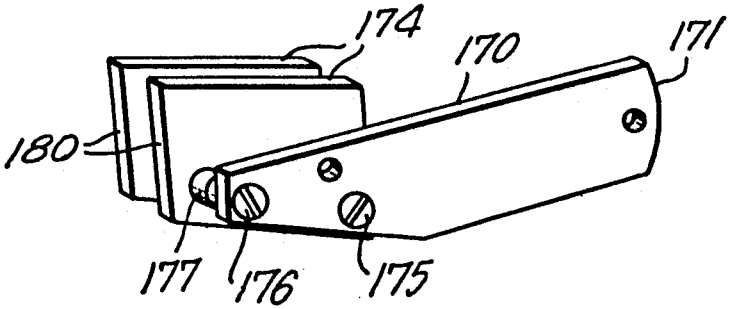
FIG. 13 is a perspective view of a coin blocking element comprising the second embodiment.
Figure 14:
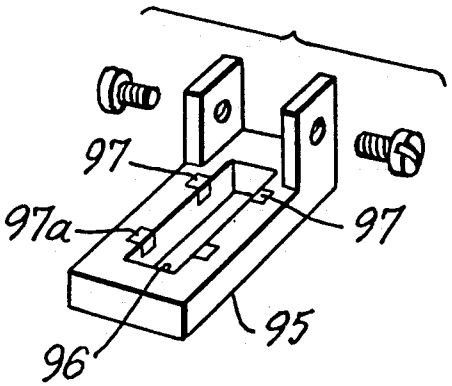
FIG. 14 is an exploded view of a coin counting means forming part of the second embodiment.
Figure 12:
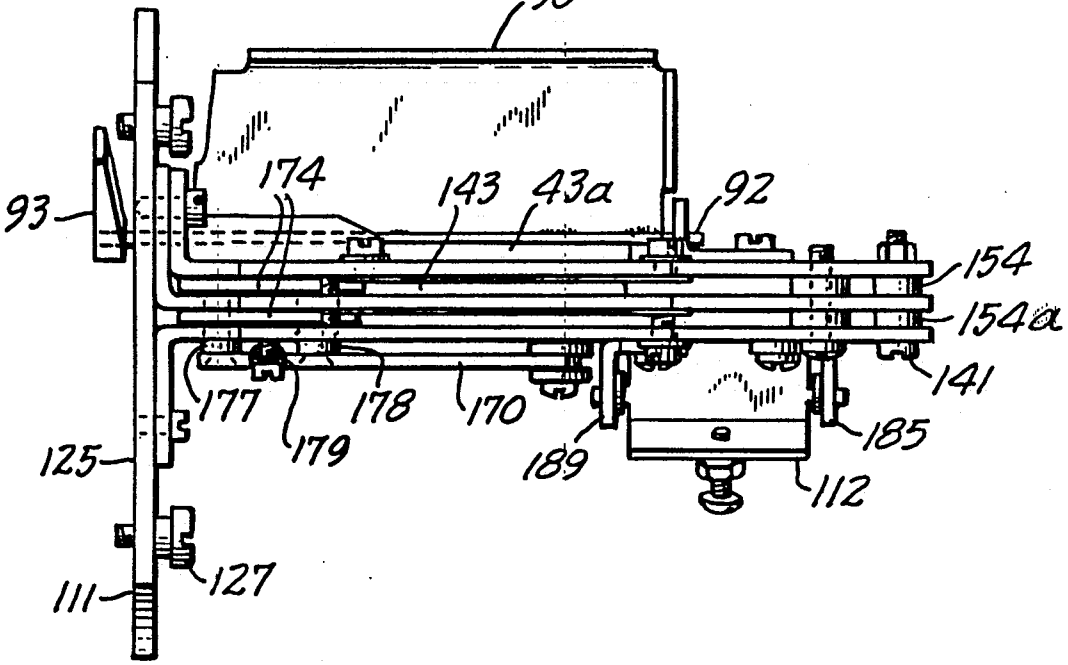
FIG. 12 is a top plan view of the second embodiment.

FIGS. 9 and 14 illustrate a novel coin sensing element mounted upon the bracket 152. It includes a horizontally oriented plate 95 having a slot 96 therethrough, and first and second electrical sensor pairs **97*a* and 97*b* of known type positioned at the ends of the slot 96. The slot 96 is sufficiently long to pass the large denominated coin, at which time, both pairs 97*a* and 97*b* make a simultaneous count to electronically credit the user with the larger denomination. When an accepted smaller coin of lesser denomination enters the slot 96**, because of the relative spacing of the pairs, only one of the pairs will sense the coin, and the user will be credited with the lesser denomination. The electronic circuits utilizing suitable counting mechanisms for this purpose are well known in the art, and form no part of the present disclosure. Since the larger denomination coins will normally be a multiple of the value of the smaller coins, the larger coin will trigger the appropriate number of pulses to the counter, while the smaller coin will effect the triggering of only a single pulse, again, as is known in the art.

It may thus be seen that I have provided an improved construction over my earlier construction disclosed in the above-mentioned copending application in which all of the functions of the earlier construction are obtained while still permitting a lower overall height of the construction, thus adapting it to be installed in those appliances having limited space enclosing an existing coin slide. Moreover, the employment of the second embodiment of the invention permits the acceptance and crediting of coins of multiple denomination, one being a multiple in value of the other, with means for crediting the user accordingly. Optional means is provided for the return of genuine coins of improper denomination to the user, without the necessity of returning worthless slugs and the like.

I wish it to be understood that I do not consider the invention to be limited to the precise details of structure shown and set forth in this specification, for obvious modifications will occur to those skilled in the art to which the invention pertains.

I claim:

1. An improved coin drop construction suitable for replacing the coin slide elements of a coin collector box forming part of a coin operated appliance comprising: a front mounting plate adapted to overlie an opening in said appliance, and a coin guide element carried by an inner surface of said mounting plate and serving to guide inserted coins to said collection box; said guide element including first and second plates interconnected in spaced parallel relation to define an elongated coin channel therebetween, said mounting plate having a coin receiving opening communicating with said channel; a first coin blocking means pivotally mounted between said plates at a first end thereof, said means including a first end located in the area of said coin receiving opening, and having an upper longitudinal edge surface forming a path for conducting a coin therealong; an elongated track member in fixed relation between said plates and having an upper surface forming a continuation of said upper edge of said first coin blocking means when at a lower limit of its path of travel, resilient means bearing upon said first coin blocking means to at least partially block said opening; insertion of a coin through said opening serving to momentarily displace said first coin blocking means downwardly to permit passage of said coin, release of said coin permitting said first coin blocking means to return to its initial position, in which said upper edge is positioned above said upper surface, and said coin is rolled over said edge under the action of gravity to a second end of said track member; a second coin blocking means positioned at said second end of said track member, said second coin blocking means including a pivotally mounted plate forming a continuation of said upper surface of said track member in the presence of an underweight coin, and being pivotally displaced under the weight of a properly weighted coin to allow said coin to fall into said coin collection box.

2. An improved coin device construction in accordance with claim 1, further characterized in a second elongated coin channel parallel to said first mentioned channel for the reception of coins of denominations different from those received by said first mentioned channel, said front mounting plate having a second slot communicating with said second channel.

3. An improved coin drop construction in accordance with claim 1, further characterized in the provision of an opening in one of said plates for the rejection of undersized coins passing along said channel.

4. Improved coin drop construction in accordance with claim 2, further characterized in each of said first mentioned and second channels having a juxtaposed opening in one of the plates forming a respective channel for the rejection of undersized coins passing along said respective channel, whereby a rejected coin from either channel will follow a common path laterally oriented with respect to said respective channel.

5. Improved coin drop construction in accordance with claim 3, further comprising an elongated coin chute underlying said opening for the reception of rejected coins.

6. An improved coin drop construction in accordance with claim 5, further characterized in said chute being arranged for pivotal movement about an axis parallel to the principal axis thereof, said front mounting plate having an additional opening selectively alignable with said chute in one relative location thereof for the reception of rejected coins therethrough.

7. An improved coin drop construction in accordance with claim 2, further comprising electrical coin sensing means for crediting a user with the acceptance of coins of either of two denominations, one denomination being a multiple of the other, said coin sensing means including a horizontally oriented plate positioned to receive coins from either of said coin channels, and having an elongated slot therein through which coins of either denomination may pass; and plural pairs of electrical coin sensing means located at either end of said slot in such relative positions that passage of a coin of larger denomination will activate simultaneously both pairs of sensing means, and passage of a coin of lesser denomination will activate only one pair of said sensing means.

* * * * *